United States Patent [19]

Chuss et al.

[11] 4,201,627

[45] May 6, 1980

[54] COKE QUENCHING PRACTICE FOR ONE-SPOT CARS

[75] Inventors: David M. Chuss; James W. Scheirer, both of Bethlehem, Pa.

[73] Assignee: Bethlehem Steel Corporation, Bethlehem, Pa.

[21] Appl. No.: 20,682

[22] Filed: Mar. 15, 1979

[51] Int. Cl.[2] ..... C10B 39/12; C10B 39/04; C10B 33/00

[52] U.S. Cl. ..... 201/39; 201/41; 202/227; 202/262

[58] Field of Search ..... 432/83; 201/39, 41; 202/227, 262; 110/171; 134/34

[56] References Cited

U.S. PATENT DOCUMENTS

| | | | |
|---|---|---|---|
| 849,429 | 4/1907 | Schumacher | 105/273 |
| 1,677,973 | 7/1928 | Marquard | 202/227 X |
| 2,232,116 | 2/1941 | Koppers | 202/227 |
| 3,806,425 | 4/1974 | Ekholm | 201/39 |
| 3,876,143 | 4/1975 | Rossow et al. | 201/39 X |
| 3,924,543 | 12/1975 | Mantione | 105/257 |
| 4,106,642 | 8/1978 | Hayduk | 202/262 X |
| 4,113,572 | 9/1978 | Manda et al. | 201/39 X |
| 4,123,334 | 10/1978 | Emery | 202/262 |

FOREIGN PATENT DOCUMENTS 2506071 8/1975 Fed. Rep. of Germany ..... 201/39

OTHER PUBLICATIONS

*Spray Nozzles and Accessories,* Spraying Systems Co., Industrial Catalog No. 26, p. 18 and Drawing No. 8303.

*Primary Examiner*—R. E. Serwin
*Assistant Examiner*—Roger F. Phillips
*Attorney, Agent, or Firm*—Joseph J. O'Keefe; Michael J. Delaney; Anson W. Biggs

[57] ABSTRACT

A process for quenching hot coke discharged from an oven of a battery of coke ovens into a one-spot car. The process utilizes a unique arrangement of two sets of narrow angle spray nozzles to quench the coke. In addition to quenching the coke, one set of spray nozzles initially knocks down the peak portion of the coke pile and distributes the coke so that the exposed surface of the coke is substantially level. The quench liquid discharged through the narrow angle spray nozzles contacts about 50% to about 70% of the substantially level, exposed surface of the hot coke. Sufficient openings are provided adjacent the bottom of the one-spot car to drain the quench liquid to prevent the buildup of quench liquid in the quench car.

12 Claims, 6 Drawing Figures

11
40
39
46
41
47
44
48
13
43
49
50
42
51
45
52
25
38
30
10
14
31
2
2
12

3
40
3
4
38
39
5
10
18
4
18'
25
13
14
15
16
6
22
17
19
20
5
6
21
30
12
12
31

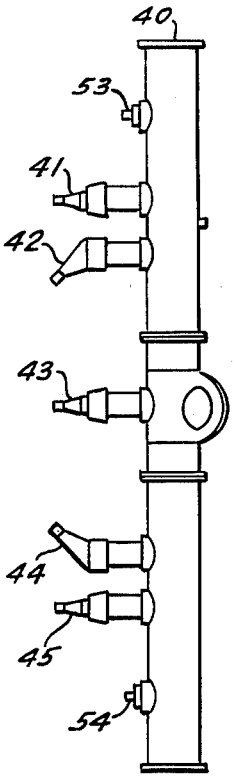
FIG. 3
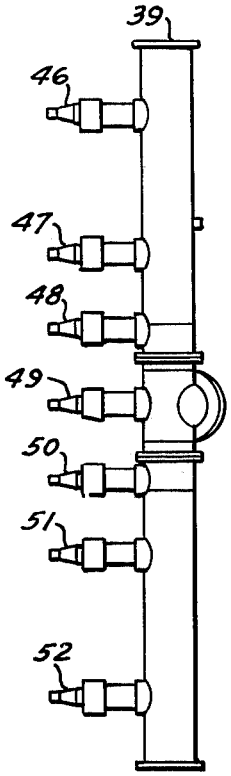
FIG. 4
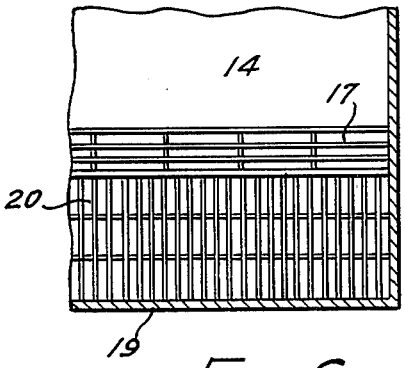
FIG. 6
FIG. 5
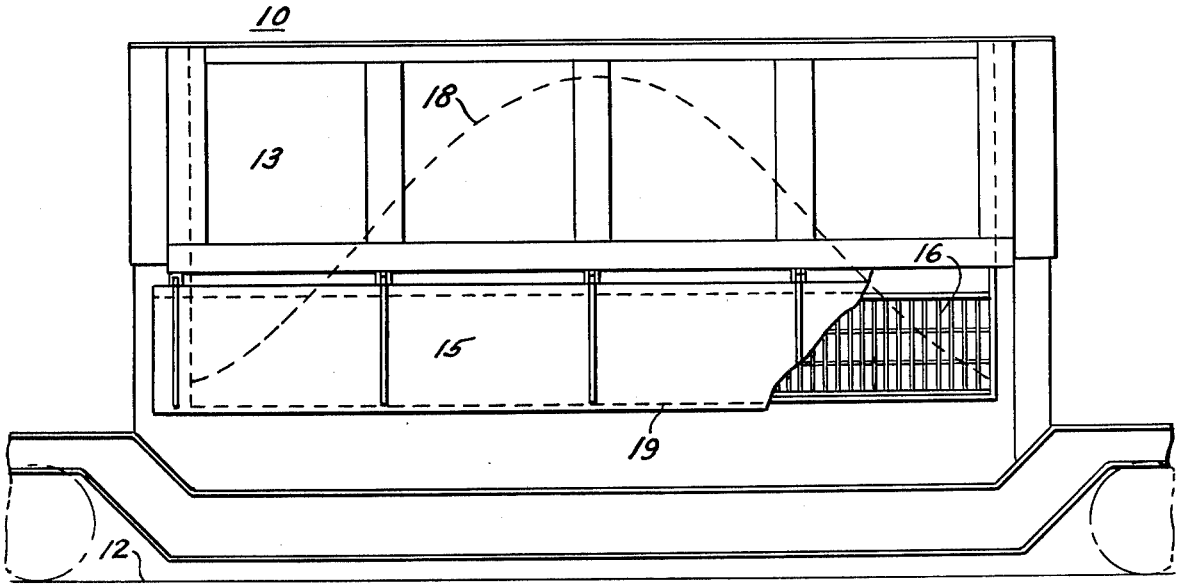

COKE QUENCHING PRACTICE FOR ONE-SPOT CARS

BACKGROUND OF THE INVENTION

The present invention relates to an improved process for quenching coke in an installation utilizing a one-spot quench car by providing for effective distribution of quench liquid.

The recent introduction of a one-spot quench car has created some serious problems for the coke manufacturer in the quality of the coke produced. For example, hot coke which is deposited in a one-spot coke quench car forms a high conical pile of hot coke with the depth of bed of coke under the peak portion reaching as much as about eight feet. Difficulty is experienced in getting sufficient quench liquid to all areas of the uneven bed of coke and hot spots in the coke are evident when the quenched coke is dumped on the wharf. The hot spots require additional manual quenching to avoid damage to conveyor equipment. Furthermore, a uniform moisture content throughout the bed of coke is desirable but practically impossible of attainment when manual quenching is required.

Many attempts have been made to apply quench liquid to a bed of hot coke in a manner that will "put out the fire" sufficiently to avoid hot spots while producing a quality coke having a relatively low and substantially uniform moisture content. For example, U.S. Pat. No. 3,806,425 to Eckholm et al discloses quenching coke with solid streams of quench liquid to drive the quench liquid to the bottom of the pile at spaced apart locations so that the quench liquid penetrates the depth of the bed prior to complete vaporization and percolates through the bed quenching coke as it goes. The quench liquid is drained out of the bottom to prevent an accumulation thereof to avoid flooding.

U.S. Pat. No. 1,677,973 to Marquard attempted to control the over and under-quenching of coke by applying a deluge of water through relatively wide angle sprays in five second periods at a rate of 150–200 gals. per second. The water was then allowed to drain and the step repeated for as many sequences as necessary to adequately quench the coke.

After considering these two extremes for controlling quenching of hot coke which utilizes a one-spot quench car in which coke is pushed from a coke oven into a quench car to form a peak portion, a process was discovered which applies the quench liquid in a manner and pattern that levels the hot coke and provides for a thorough and uniform quenching of the coke.

SUMMARY OF THE INVENTION

It is therefore an object of this invention to provide an improved process for quenching coke.

It is a further object of this invention to provide a process for quenching coke in a one-spot quench car.

It is an additional object of this invention to provide a process for quenching coke in a one-spot car to produce quality coke having substantially uniform moisture content.

The present invention accomplishes these objects by providing a plurality of sets of narrow angle sprays, wherein each spray nozzle produces a full coverage spray pattern without substantial overlapping of the patterns or impact zones produced by the spray nozzles. One set of sprays is directed at the pile of coke pushed into the one-spot car from the coke oven in a pattern that knocks the peak portion of the pile of coke down to form a substantially level exposed surface of hot coke in the quench car. The continued application of quench liquid by the sets of narrow angle sprays on about 50% to about 70% of the substantially level exposed surface area of coke results in coverage which effectively quenches the hot coke. Openings in the quench car are strategically located to provide sufficient drainage of quench liquid from the quench car to prevent buildup of quench liquid in the bottom of the car.

The following terms, as used herein, shall have the meanings hereinafter set forth:

"One-spot quench car": a quench car which remains stationary during the time that coke is being pushed from a coke oven into the one-spot quench car.

"Narrow angle spray": the spray produced by a nozzle designed to have an included angle of spray of about 15° to about 25°.

"Oven side": the side of the quench car adjacent the coke side of a coke oven battery as shown in "The Making, Shaping and Treating of Steel," Ninth Edition, 1971, FIGS. 4–25, p. 135.

"Wharf side": the side of the quench car from which the quenched coke is discharged onto a coke wharf.

"Full cone spray nozzle": is a nozzle which produces a conically shaped spray pattern having a relatively uniform distribution of water throughout the entire volume, i.e. a full coverage spray pattern.

BRIEF DESCRIPTION OF THE DRAWINGS

FIG. 3 is a view of the upper header and sprays taken on line 3—3 of FIG. 2;

FIG. 4 is a view of the lower header and sprays taken on line 4—4 of FIG. 2;

FIG. 5 is a view of the one-spot quench car taken along line 5—5 of FIG. 2; and

FIG. 6 is a fragmentary section of a portion of the bench side of the one-spot quench car taken on line 6—6 of FIG. 2.

DESCRIPTION OF THE PREFERRED EMBODIMENT

Figure 1:
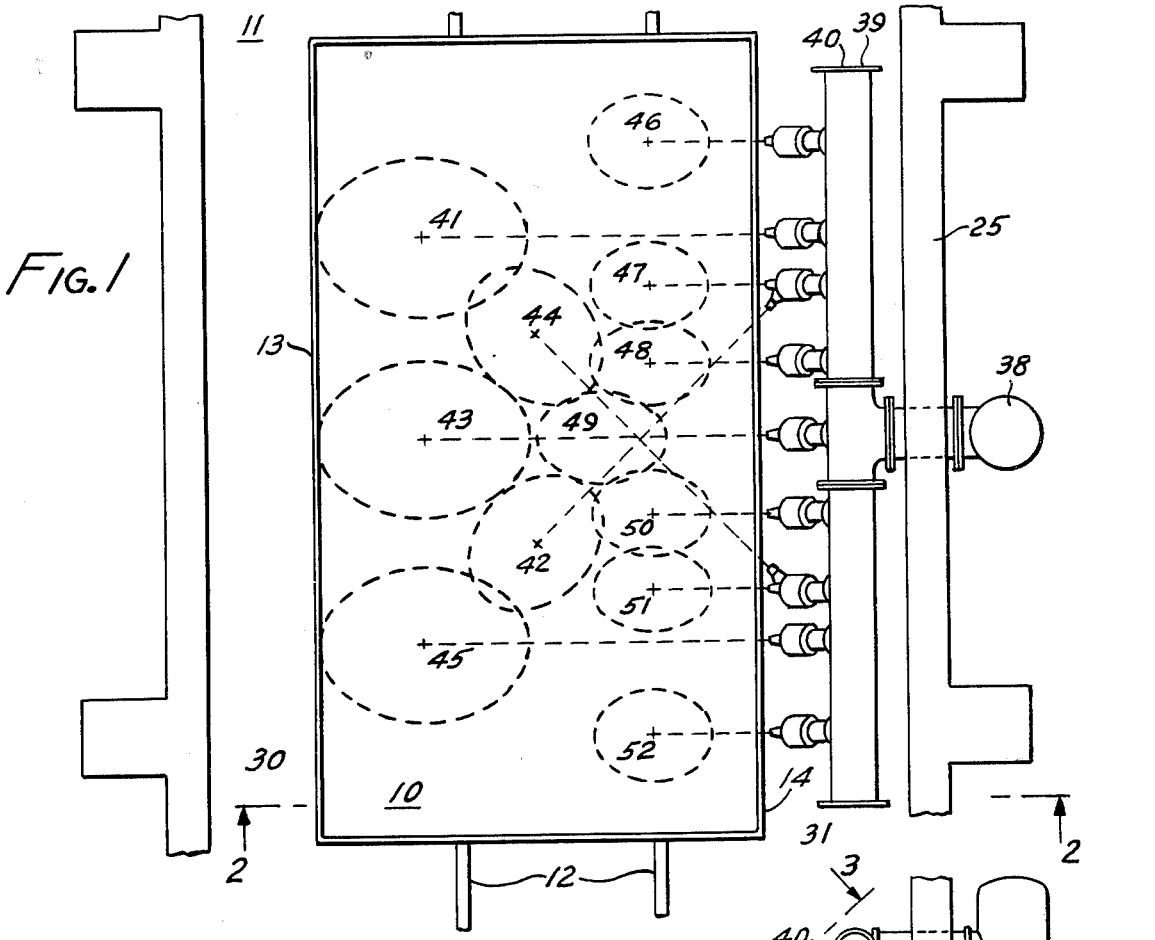
FIG. 1 is a plan view of the one-spot quench car and the quench spray pattern.
Figure 2:
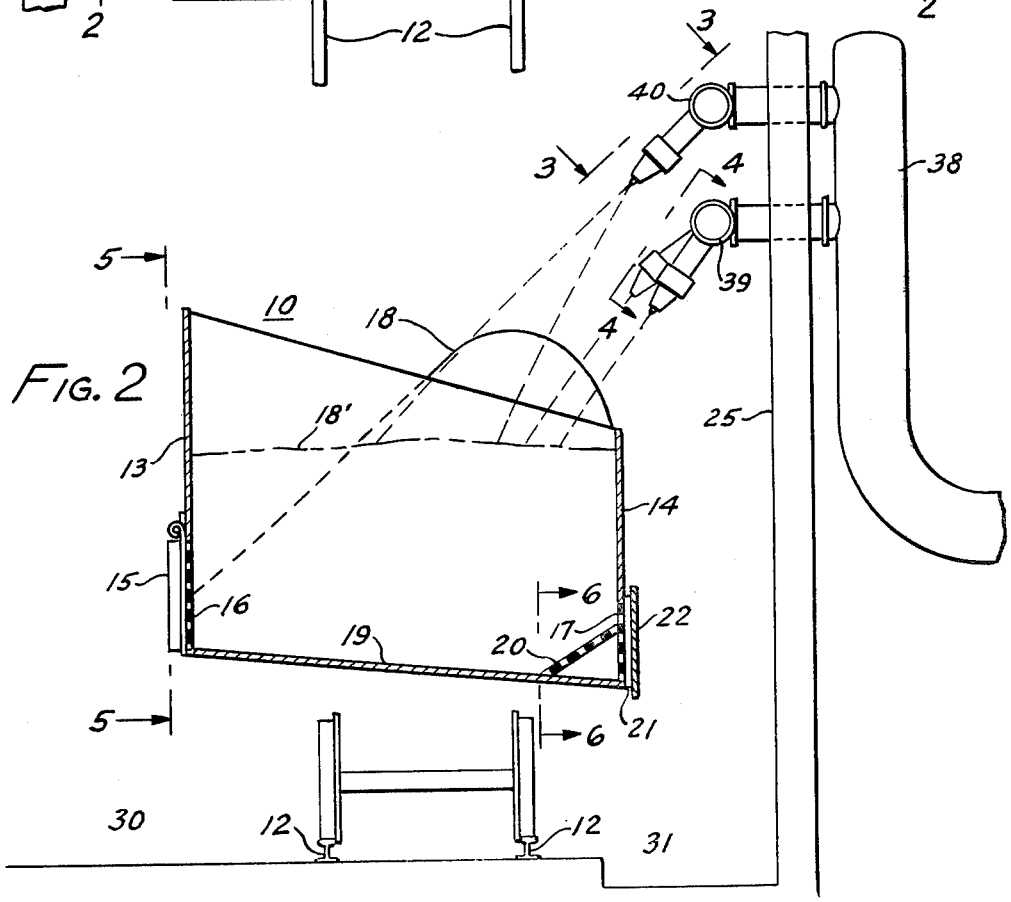
FIG. 2 is a view of the one-spot quench car and quenching station taken on line 2—2 of FIG. 1.

Referring now to the drawings and particularly to FIGS. 1 and 2, the coke quenching practice for one-spot quench cars will be described in detail. One-spot quench car 10 is seen located in a quenching station 11. The one-spot quench car 10 is moved to the quenching station 11 for quenching of the hot coke when the push is complete. Quench car 10 moves along tracks 12 which are located on the coke side of a battery of coke ovens and running parallel to the coke side bench to a quenching station 11 where the hot coke is quenched.

The profile of the coke pile after pushing into the quench car 10 appears approximately as line 18 on FIGS. 2 and 5.

Quench car 10 comprises a high side 13 which is adjacent the wharf side 30 of the tracks 12 and a low side 14 which is adjacent the oven side 31 of the tracks 12. As best seen in FIGS. 2, 5 and 6, sides 13 and 14 of quench car 10 are provided with grated drain openings 16 and 17 which extend substantially the full length of each side, adjacent the bottom. Gates 15 are pivotably hung or hinged on side 13. The gates 15 are adapted to be held shut during the push cycle and are swung outwardly from the car by escaping steam and quench water during quenching. Grated opening 17 adjacent the lower portion of side 14 of quench car 10 is covered by a heavy, e.g. ½" solid plate 22 spaced from side 14 and fixed thereto to allow continuous draining of quench liquid from quench car 10 at that point. The bottom 19 of quench car 10 is sloped at approximately 5° towards the oven side of tracks 12 to expedite the drainage of quench liquid. Sloped grated plate 20 is located adjacent the inside of side 14 extending longitudinally of the car and affixed thereto to allow the quench liquid to flow freely through the grating 20, opening 21 between the solid plate 22 and the grated opening 17. This arrangement prevents buildup of very fine particles of coke in the corner of quench car 10 at the junction of bottom 19 and side plate 14. Quench car 10 is further provided with tilting means (not shown) which allows the car to be tilted toward the wharf side 30 to discharge the quenched coke at the conclusion of the quench cycle.

Quench headers 39 and 40 are mounted on wall 25 of quenching station 11 adjacent the oven side of track 12. Upper head 40 and lower header 39 are supplied with quench liquid from conduit 38. Referring particularly to FIGS. 3 and 4, quench headers 39 and 40 are seen to comprise a plurality of spaced nozzles, the nozzles extending outwardly from the header and as seen in FIG. 2 at an angle to direct the flow of quench liquid in a desired trajectory. Upper header 40 comprises five nozzles nos. 41, 42, 43, 44 and 45 and two blanked connections 53 and 54 for the attachment of additional nozzles if desired or necessary. Lower header 39 comprises seven nozzles, including five nozzles 47–51 inclusive and two nozzles 46 and 52. Two of the nozzles 42 and 44 on the upper header 40 are set at an angle, as shown, to direct the quench liquid to the peak portion of pile 18 along with nozzles 47, 48, 49, 50 and 51 to knock the peak portion down such that the coke subsides and thereby provides a substantially level, exposed surface of coke in the quench car. The nozzles have a narrow spray angle of approximately 20° and are described as full cone sprays producing a full coverage spray pattern.

The pattern of distribution of quench liquid on the surface of the pile of hot coke in the quench car 10 is seen in FIGS. 1 and 2. The nozzles 47, 48, 49, 50 and 51 on lower header 39 and the two nozzles 42 and 44 on the upper header 40 are mounted above the surface of the coke in the quench car 10 and are angled so that the spray is directed at the peak portion of the coke pile on the oven side of the quench car while the three nozzles 41, 43 and 45 on the upper header 40 are similarly located above the coke pile surface and angled to direct the spray of quench liquid therefrom at the hot coke surface at the wharf side of the quench car. Nozzles 46 and 52 on lower header 39 are directed at the coke in the corners of the car on the oven side.

The close grouping of the five nozzles 47–51 along with nozzles 42 and 44 directed at the peak portion of the pile of hot coke results in the peak portion being knocked down and a substantially level exposed surface 18' formed. Continued flow of quench liquid onto the surface of the coke provides sufficient quenching of the entire bed of coke with the excess quench liquid flowing freely through grating drain openings 16 and 17 to prevent buildup of quench liquid in the bottom of the quench car. The impacting of the quench liquid on the coke surface, flow of liquid through the coke and the percolation of steam back up through the bed of coke all tend to cause the coke to flow as a fluid bed to the corners of the quench car, resulting in a bed of coke that is substantially uniform in depth.

The pattern of distribution of quench liquid on the substantially level exposed surface of the coke bed avoids overlapping of the areas of contact or impact of the nozzle sprays which would cause nonuniform moisture content in those small areas of overlap which get double the amount of quench liquid.

SPECIFIC EXAMPLE

The coke quenching practice of the instant invention was used to quench approximately 11.5 tons of hot coke, from a 4 meter oven, contained in a deep bed in a one-spot quench car. The hot coke was contained in a one-spot quench car having a horizontal surface area of approximately 220 sq ft (20'×11'). During the quench, the deep conical shaped coke pile, which was formed by pushing coke into the one-spot quench car, was generally levelled to a relatively uniform depth of approximately 4 to 4½ feet, which is approximately twice the depth obtained with conventional moving quench cars. This levelling is necessary to uniformly quench coke in the one-spot car.

The quenching process utilized two 12-inch diameter spray headers which were located on a side wall of the quenching station, one above the other. The vertical distance between the two headers was three feet. There were seven spray nozzles on the lower header and five spray nozzles on the upper header. Spacing between nozzles varied from 15 inches to 45 inches. The full cone spray nozzles used to produce a full coverage spray pattern had a 20 degree included angle with a discharge opening of 2-5/16" diameter. Total water flow rate through the spray system was 5,000 gallons per minute with pressures of 7½ to 8½ psig at the headers. The water or quench liquid from the spray nozzles contacted about 60% of the exposed surface area of the coke in the quench car. Thus, the quench liquid was applied to the coke in the quench car at a rate of about 37 gpm/sq. ft. of surface area contacted by the sprays. At this rate of water application the 11.5 tons of coke was quenched in 105 seconds. If water had been supplied at a faster rate, the quench time would have been considerably reduced (6,800 gpm—75 seconds quench time). After quenching, it required only approximately 45 seconds to drain any unevaporated water from the coke box. The quench water was recirculated and normally had a temperature of ~68° C.

It was discovered that a practical range of flow-rates was between 5000 gpm and 8000 gpm to provide an efficient quench time/drain time ratio. In the above specific example when 8000 gpm was used the quench liquid was applied to the coke in the quench car at a rate of about 59 gpm/sq. ft. of surface area contacted by the sprays.

The quench liquid from a first set of spray nozzles, i.e. nozzles 42 and 44 spaced 7'-6" apart on upper header 40 and nozzles 47–51 spaced 1'-10½" apart on lower header 39, in a first pattern was applied to impact upon the peak portion of the coke in the car to cause the peak portion to subside and thereby provide a substantially level exposed surface of coke in the quench car. As mentioned hereinbefore the fluid nature of the coke under the influence of the impacting quench liquid, liquid flow through the coke and the percolating steam caused the peak portion of coke to flow into the corners of the car and assume a substantially level surface. The coke of the peak portion which flows into the corners is substantially quenched during movement to the corners. Thus direct application of quench liquid from the spray nozzles is not necessary. This accounts for the absence of a spray pattern in the corners of the car adjacent patterns 45 and 41 of FIG. 1.

Quench liquid from a second set of spray nozzles, i.e. nozzles 41, 43 and 45 space 5'-0" apart on upper header 40, and nozzles 46 and 52 spaced 3'-6" outwardly respectively from nozzles 47 and 51 on lower header 39 in a second pattern was applied to impact upon areas of the coke surface not covered by the first set of spray nozzles so that the sum of the area contacted by the first pattern and the area contacted by the second pattern equals about 50% to about 70% of the substantially level, exposed surface area of coke in the quench car.

The force of water on the coke surface due to the momentum of the water coming from the 20° full cone spray nozzles having 2-5/16" diameter openings at the rate of 5000 gpm results in a vertical component per nozzle of 47 lbs. and a horizontal component of 32.5 lbs. If the flow rate is raised to 8000 gpm the vertical force is 74.3 lbs. and the horizontal force acting on the pile of coke is 52.5 lbs. These forces of water on the coke surface are for one nozzle. The 20° spray nozzle impacts on an area of about 4.8 $ft^2$ so the force is spread over this 4.8 $ft^2$ area of coke.

It will be clear to those skilled in the art that any pipe or spray could produce the same force as the 20° nozzles, given the same flow rate, however the area of impact is variable. If the area of impact on the coke surface is too small the force would tend to drive the water through the coke, forming a hole therein. If the area of impact is too large the effect of the force of the water on the impact area of the coke would be to quench the surface of the coke but not move it, i.e. knock the peak portion of the coke pile down.

Water was able to drain through grates on both the wharf side and oven side of the coke car and during the quench there was no substantial buildup of water in the coke car. The floor of the quench car was sloped 5 degrees towards the bench side to completely drain all water from the car prior to dumping coke on the wharf. The drainage grates through which the unevaporated water was allowed to drain from the quench car had an open area of about 4500 $in^2$. Drainage times of from 45–70 seconds were attained with no hot coke remaining after quenching.

In order to prevent excessive indrafting of air through the grates during the time when coke was being pushed from the oven into the one-spot quench car and while the quench car was under a slight suction from a fan or other gas mover which was capturing pushing emissions, all or part of the drainage grates at the bottom of this car were covered. While the coke was being quenched in the quench station these covers did not restrict the free flow of unevaporated quench water or steam from exiting the coke quench car. The above was accomplished by using solid metal plates which were hinged at the top and covered the grated drain opening on the outside of the quench car. These solid doors were made of light gauge steel and were held shut while the car was under vacuum during the pushing cycle and were pushed outward by escaping steam and quench water during quenching.

ALTERNATE EMBODIMENT

Drainage areas as large as 8,000 $in.^2$ (55.5 $ft.^2$) may be used with this quench system. A good range for the drainage area is between 2,500 $in.^2$ (17.4 $ft.^2$) and 8,000 $in.^2$ (55.5 $ft.^2$). Using drain grates with such a large drainage area is advantageous for quick drainage of unevaporated water from the quench car after the application of quench water is stopped as well as for allowing steam pressure to be released freely during quenching and thereby preventing coke eruptions or degradation of coke into coke breeze during the quenching operation. As noted hereinabove, drainage times of 45–70 seconds are possible with no hot coke remaining after quenching. In one-spot quench systems which require a more water tight quench car, i.e., less open area on the drainage grates, in order to achieve effective quenching, the drain time after stoppage of quench water can be as high as three minutes. This long drain time is necessary to avoid dumping large quantities of water on the coke wharf when the coke is discharged from the quench car. This lengthens the overall time required for the quenching and draining operation which in turn lengthens the overall cycle time, i.e., quench time plus drain time, of the one-spot quench car operation to such an extent that lost coke production can result. Drainage grates for use with the sprays employed in this system are provided on both the wharf side and the battery side of the coke quench car. Having drainage grates on both sides of the quench car prevents any substantial buildup of water in the box during quenching. This buildup is avoided in order to reduce the time required for drainage of unevaporated water after application of quench water is stopped. Sloping the floor of the box slightly (5 degrees) downward toward either side facilitates the drainage of any water still lying on the bottom of the box after quenching is completed.

Rates of quench water flow as supplied to the narrow 20° angle full cone spray nozzles employed with this process are 100 $gpm/ft^2$ of open drainage area. Higher rates of quench water flow of 200 $gpm/ft^2$ of open drainage area would be advantageous in lowering the overall cycle time spent in the quench station. However, as the rate of quench water is increased for a constant drainage area, there reaches a point where the water begins to build up in the quench car during the quench. When this occurs eruptions of coke from the car take place and the time required for drainage will be increased to a greater extent than the decrease in quench time which normally follows with the use of higher water flow rates. This then increases the overall cycle time devoted to quenching and draining of the water from the coke. Drainage areas much greater than 8000 $in.^2$ are not practical for a one-spot quench car because the quench car is under vacuum and any modification which increases the drainage openings would alter the suction rates. In addition, inflow of air through the openings creates a chimney effect resulting in higher heat causing warpage of the quench car parts. Water flow rates above 500 $gpm/ft^2$ of the drainage opening should be avoided because of the inability of the drainage openings to carry the water away to prevent buildup of water in the bottom of the car. When the water flow rate is over 1000 $gpm/ft^2$ of drainage area, large eruptions of coke from the box occur creating a housecleaning problem in the quench station as well as degrading the coke and causing formation of additional coke breeze, all of which are not desirable from the standpoint of an efficient operation. Such high rates of water application with minimal drainage of the quench liquid from the quench car are employed with quench piping systems which rely more heavily on water buildup in the quench car in order to achieve effective quenching.

Effective quenching of hot coke may be accomplished by using full cone spray nozzles which produce a full coverage spray pattern with an included angle of about 15 to about 25 degrees. Using such a narrow spray angle nozzle has two primary advantages over conventional full cone nozzles, which produce sprays having included angles of as much as ~100 degrees, when quenching coke in the one-spot quench cars: (1) they produce a larger impact force which causes the conical pile of coke to level out, and (2) they provide for a condition of mininum overlap of spray water from adjacent nozzles which reduces the variability in the moisture content of the coke and lowers the average moisture content of the coke. The narrow spray angles are necessary in quenching coke in the one-spot cars because these cars are only approximately ½ the length of conventional "moving" quench cars. Using conventional wide angle sprays with an equivalent flow rate of water for such a short quench car would result in overquenched coke in large areas where the sprays overlap. Also, the conventional wide angle sprays are unacceptable for quenching the deep beds of coke inherent in the one-spot quench cars mainly because of the excessively long quench times which are required with such nozzles.

When quenching of the hot coke must be accomplished by spraying from the side walls of the quench tower (as opposed to conventional overhead sprays) such as is required by one-spot quench cars which are enclosed at the top and as described in the specific example, these narrow angle nozzles have an advantage over open ended pipes in that a better trajectory of water is supplied with the nozzles thus allowing for better coverage of water on the bed of hot coke. The quench systems which employ open ended pipes are generally designed to operate at very low pressures so as to avoid any breakup of the water streams. These low pressures result in a poor trajectory of water which essentially provides for little or no water on the coke farthest away from the spray headers. This results in hot spots of incandescent coke in the coke bed after quenching and requires additional quenching. Using the narrow angle, about 15 degrees to about 25 degrees, spray nozzles, a much larger area of the coke is sprayed and there is no hot coke remaining after quenching. The arrangement of spray nozzles contacts a major portion of the exposed surface of coke in the quench car with quench liquid. Contacting 60% of the coke surface with quench liquid results in an effective quench. Another advantage of the 20 degree nozzles over the open ended pipe system is that levelling of the conical shaped hot coke pile is done gently without causing large eruptions which result in coke being thrown from the coke receiving box. When these coke eruptions occur a "housecleaning" problem is created. When using the narrow angle spray nozzles to quench coke, no substantial submergence of coke occurs during the quenching cycle, provided of course that the quench car has properly designed drainage openings of adequate free area to drain off the unevaporated quench water.

SUMMARY

The primary aim of this process is to apply a forceful coarse spray of water capable of levelling the conical shaped pile of hot coke into a pile of uniform depth, with minimal overlap of adjacent sprays, thereby providing for uniform quenching. Drainage area should be sufficient so that coke is not submerged in quench water, and that the drainage time after quenching is not excessive. The quenching is accomplished in a relatively short time without causing large eruptions of the coke from the quench car. Average moisture content of the quenched coke is acceptable.

It will be apparent to those skilled in the art that various modifications may be made without departing from the spirit of the invention or the scope of the appended claims. There are many forms of one-spot quench cars to which the invention described herein is applicable as, e.g., sloped bottom cars, open cars, covered cars, tiltable cars, etc.

We claim:

1. A process for quenching coke in which coke is pushed from a coke oven into a one-spot quench car to form a peak portion and the quench car is provided with openings adjacent the quench car bottom, comprising the steps of:
   (a) providing a plurality of sets of full cone spray nozzles with each nozzle having a spray angle in the range of about 15° to about 25° to dispense a quench liquid in a full coverage spray pattern to quench the coke,
   (b) applying the quench liquid from a first set of spray nozzles in a first pattern to initially impact upon the peak portion of the coke in the car to cause the peak portion to subside and provide a substantially level, exposed surface of coke in the quench car and to thereafter impact upon areas of the substantially level, exposed surface of coke,
   (c) substantially simultaneously with step (b) applying the quench liquid from a second set of spray nozzles in a second pattern to impact upon areas of the coke surface not covered by the first set of spray nozzles, so that the sum of the areas contacted by the first pattern and the areas contacted by the second pattern equals about 50% to about 70% of the substantially level, exposed surface area of coke in the quench car, and
   (d) providing sufficient openings to drain the quench liquid from the quench car and to prevent the buildup of quench liquid in the bottom of the quench car.
2. The process according to claim 1 wherein the sum of paragraph (c) equals about 60%.
3. The process according to claim 1 wherein quench liquid is applied to the coke in the quench car at a rate of about 37 to about 59 gpm per squ. ft. of substantially level, exposed surface area contacted by said spray nozzles.
4. The process according to claim 1 wherein the time that quench liquid is applied to the coke in the quench car is between about 75 and 105 seconds.
5. The process according to claim 1 wherein the time to drain the quench liquid from the quench car is between 45 and 70 seconds after the application of quench liquid ceases.
6. The process according to claim 1 wherein there is no substantial overlapping between the areas of the coke surface impacted by the spray nozzles.

7. The process according to claim 2 wherein quench liquid is applied to the coke in the quench car at a rate of about 37 to about 59 gpm per sq. ft. of substantially level, exposed surface area contacted by said spray nozzles.

8. The process according to claim 2 wherein the time that quench liquid is applied to the coke in the quench car is between about 75 and 105 seconds.

9. The process according to claim 2 wherein the time to drain the quench liquid from the quench car is between 45 and 70 seconds after the application of quench liquid ceases.

10. The process according to claim 8 wherein quench liquid is applied to the coke in the quench car at a rate of about 37 to about 59 gpm per sq. ft. of substantially level, exposed surface area contacted by said spray nozzles.

11. The process according to claim 10 wherein the time to drain the quench liquid from the quench car is between 45 and 70 seconds after the application of quench liquid ceases.

12. The process according to claim 11 wherein there is no substantial overlapping between the areas of the coke surface impacted by the spray nozzles.

* * * * *